US009806464B1

(12) United States Patent
Wang et al.

(10) Patent No.: US 9,806,464 B1
(45) **Date of Patent: *Oct. 31, 2017**

(54) STRUCTURE OF ELECTRICAL CONNECTOR

(71) Applicant: Allsmartlite Technology Co., Ltd., Shenzhen (CN)

(72) Inventors: Xiaoping Wang, Shenzhen (CN); Ming-Han Perng, Shenzhen (CN); Chien-Hsing Lai, Shenzhen (CN)

(73) Assignee: ALLSMARTLITE TECHNOLOGY CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/263,379

(22) Filed: Sep. 13, 2016

(51) Int. Cl.

| | |
|---|---|
| ***H01R 13/6471*** | (2011.01) |
| ***H01R 13/516*** | (2006.01) |
| ***H01R 24/60*** | (2011.01) |
| *H01R 107/00* | (2006.01) |

(52) U.S. Cl.
CPC ..... *H01R 13/6471* (2013.01); *H01R 13/516* (2013.01); *H01R 24/60* (2013.01); *H01R 2107/00* (2013.01)

(58) Field of Classification Search
CPC ... H01R 13/6471; H01R 13/516; H01R 24/60
USPC ..... 439/607.01
See application file for complete search history.

(56) References Cited

U.S. PATENT DOCUMENTS

| | | | | |
|---|---|---|---|---|
| 7,771,238 | B2 * | 8/2010 | Aoki | G06K 19/07732 235/441 |
| 7,918,673 | B1 * | 4/2011 | Mimura | H01R 13/6471 439/101 |
| 8,277,253 | B2 * | 10/2012 | Lee | H01R 12/724 439/540.1 |
| 8,393,920 | B2 * | 3/2013 | Yu | H01R 13/6461 439/660 |
| 8,398,438 | B2 * | 3/2013 | Zhang | H01R 13/6471 439/660 |
| 8,672,711 | B2 * | 3/2014 | Kondo | H01R 12/57 439/607.1 |
| 8,747,149 | B2 * | 6/2014 | Wu | H01R 13/658 439/108 |
| 8,801,462 | B2 * | 8/2014 | Tsai | H01R 12/724 439/607.01 |

(Continued)

*Primary Examiner* — Alexander Gilman
(74) *Attorney, Agent, or Firm* — Leong C. Lei

(57) ABSTRACT

An improved structure of an electrical connector generally includes a shielding enclosure, at least one insulation body, an upper transmission conductor assembly, and a lower transmission conductor assembly. The upper and lower transmission conductor assemblies include an upper grounding terminal assembly, an upper power terminal assembly, a lower grounding terminal assembly, and a lower power terminal assembly, of which each terminal assembly defines a soldering section, an extension section, and a contact section. The soldering section has a width from 0.35 mm to 0.45 mm and a thickness from 0.15 mm to 0.25 mm. The extension section has a width from 0.35 mm to 0.45 mm and a thickness from 0.15 mm to 0.25 mm. The contact section has a width from 0.195 mm to 0.295 mm and a thickness from 0.15 mm to 0.25 mm. With such an arrangement, electrical current loading of the terminals can be effectively increased to meet the need for a large current without increasing noise interference.

6 Claims, 5 Drawing Sheets

(56) References Cited

U.S. PATENT DOCUMENTS

| | | | | |
|---|---|---|---|---|
| 9,142,926 | B2 * | 9/2015 | Tsai | H01R 24/60 |
| 9,203,176 | B2 * | 12/2015 | Dong | H01R 13/516 |
| 9,231,356 | B1 * | 1/2016 | Ju | H01R 24/78 |
| 9,318,853 | B2 * | 4/2016 | Little | H01R 13/6658 |
| 9,350,126 | B2 * | 5/2016 | Little | H01R 24/60 |
| 9,356,400 | B2 * | 5/2016 | Little | H01R 4/023 |
| 9,478,916 | B2 * | 10/2016 | Kao | H01R 13/6593 |
| 9,478,923 | B2 * | 10/2016 | Kao | H01R 24/60 |
| 9,525,227 | B2 * | 12/2016 | Little | H01R 13/6273 |
| 2013/0063908 | A1 * | 3/2013 | Lee | H01R 13/405 361/752 |
| 2014/0370729 | A1 * | 12/2014 | Wang | H01R 13/6471 439/108 |
| 2015/0162714 | A1 * | 6/2015 | Yu | H01R 24/62 439/660 |
| 2015/0171573 | A1 * | 6/2015 | Little | H01R 24/60 439/607.34 |
| 2016/0294121 | A1 * | 10/2016 | Daughtry, Jr. | H01R 13/405 |
| 2016/0378632 | A1 * | 12/2016 | Srivastava | G06F 11/3051 714/5.1 |
| 2017/0085038 | A1 * | 3/2017 | Duan | H01R 24/64 |

* cited by examiner

STRUCTURE OF ELECTRICAL CONNECTOR

TECHNICAL FIELD OF THE INVENTION

The present invention relates generally to an improved structure of an electrical connector, and more particularly to an improved structure of an electrical connector, in which widths and thicknesses of a grounding terminal and a power terminal are increased, in a limited manner, in order to meet the need for supply of a large electrical current and also to eliminate noise interference.

DESCRIPTION OF THE PRIOR ART

Universal serial bus (UBS) has been widely used due to being capable of hot plugging. Transmission speeds of electronic signals have been constantly increased and thus, interfaces for transmission of electronic signals must be unceasingly improved and renovated, such as variation of the type and number of interfaces for signal transmission, in order to increase the speed of transmission of electronic signals. This also causes expansion of the interface for transmission of electronic signals and consequently, drawbacks such as occupying additional space and influencing circuit layout may result.

Due to miniaturization of all sorts of electronic products, a high-speed transmission interface arranged therein must also be subjected to miniaturization in order to increase the number of metal conductors and also the distribution density thereof. The conventional USB interfaces are arranged such that metal conductors thereof are arranged to be very close, spatially, to each other so that capacitive coupling would occur during the transmission of signals and thus increasing interference with the transmission of the signals and lowering stability of signal transmission. In addition, impedance matching is necessary between a high-speed transmission interface and a system main board interface and interference can only be reduced with such a condition satisfied to allow signal transmission to be correctly carried out between the high-speed transmission interface and the system main board interface; otherwise signal transmission conducted between the high-speed transmission interface and the system main board interface would result in signal reflection, leading to loss, deformation, and distortion of electronic signals, eventually making bandwidth and quality of electronic signal not reaching standards and affecting normal operations of electronic devices.

Thus, it is a challenge of those involved in this industry to provide a solution that overcomes the problems and drawbacks of the prior art and allows for an increase of an electrical current to be transmitted with a limited arrangement of quantity, size, and volume of terminals, while not affecting transmission quality.

SUMMARY OF THE INVENTION

The primary object of the present invention is to increase widths and thicknesses of a grounding terminal and a power terminal of a high-frequency connector to predetermined values that meet the need for a large electrical current without causing a negative effect of noise interference.

To achieve the above object, the present invention provides a structure that comprises: a shielding enclosure and at least one the insulation body arranged inside the shielding enclosure. The insulation body comprises an upper transmission conductor assembly mounted thereto. The upper transmission conductor assembly comprises an upper grounding terminal assembly and an upper power terminal assembly arranged in the upper grounding terminal assembly. Further, the insulation body comprises a lower transmission conductor assembly mounted thereto. The lower transmission conductor assembly comprises a lower grounding terminal assembly and a lower power terminal assembly arranged in the lower grounding terminal assembly. Further, the upper grounding terminal assembly, the upper power terminal assembly, the lower grounding terminal assembly, and the lower power terminal assembly define, at one end thereof, soldering sections. The soldering sections have a width that is from 0.35 mm to 0.45 mm. The soldering sections have a thickness that is from 0.15 mm to 0.25 mm. The upper grounding terminal assembly, the upper power terminal assembly, the lower grounding terminal assembly, and the lower power terminal assembly define thereon extension sections respectively at one side of the soldering sections. The extension sections have a width that is from 0.35 mm to 0.45 mm. The extension sections have a thickness that is from 0.15 mm to 0.25 mm. And, the upper grounding terminal assembly, the upper power terminal assembly, the lower grounding terminal assembly, and the lower power terminal assembly define thereon contact sections located on one side of the extension sections that is distant from the soldering sections. The contact sections have a width that is from 0.195 mm to 0.295 mm. The contact sections have a thickness that is from 0.15 mm to 0.25 mm. When a user arranges terminal volumes of a connector according to such figures, electrical current loading of the terminals can be effectively increased to meet the need for supply of a large current and also to eliminate noise interference.

With the above-described technique, the drawbacks of the conventional high-frequency connectors that the electrical current loading of the terminals is insufficient, the volume of the terminals is excessively large, and noise interference is severe can be overcome and the above advantages can be achieved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
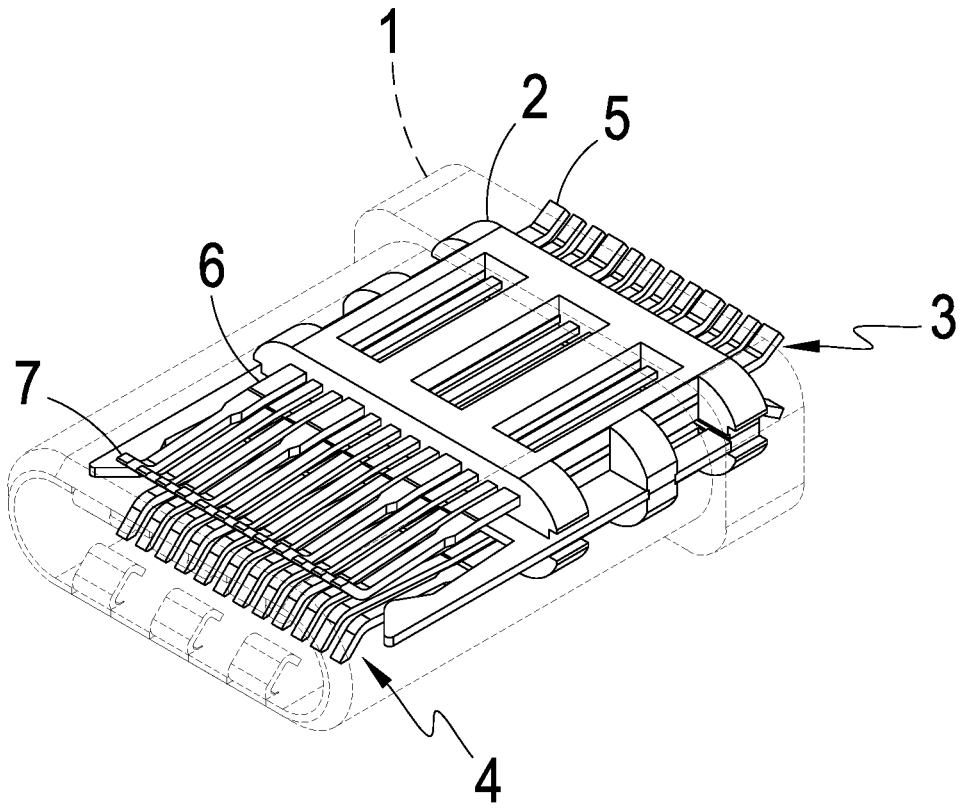
FIG. 1 is a perspective view showing a preferred embodiment of the present invention.
Figure 2:
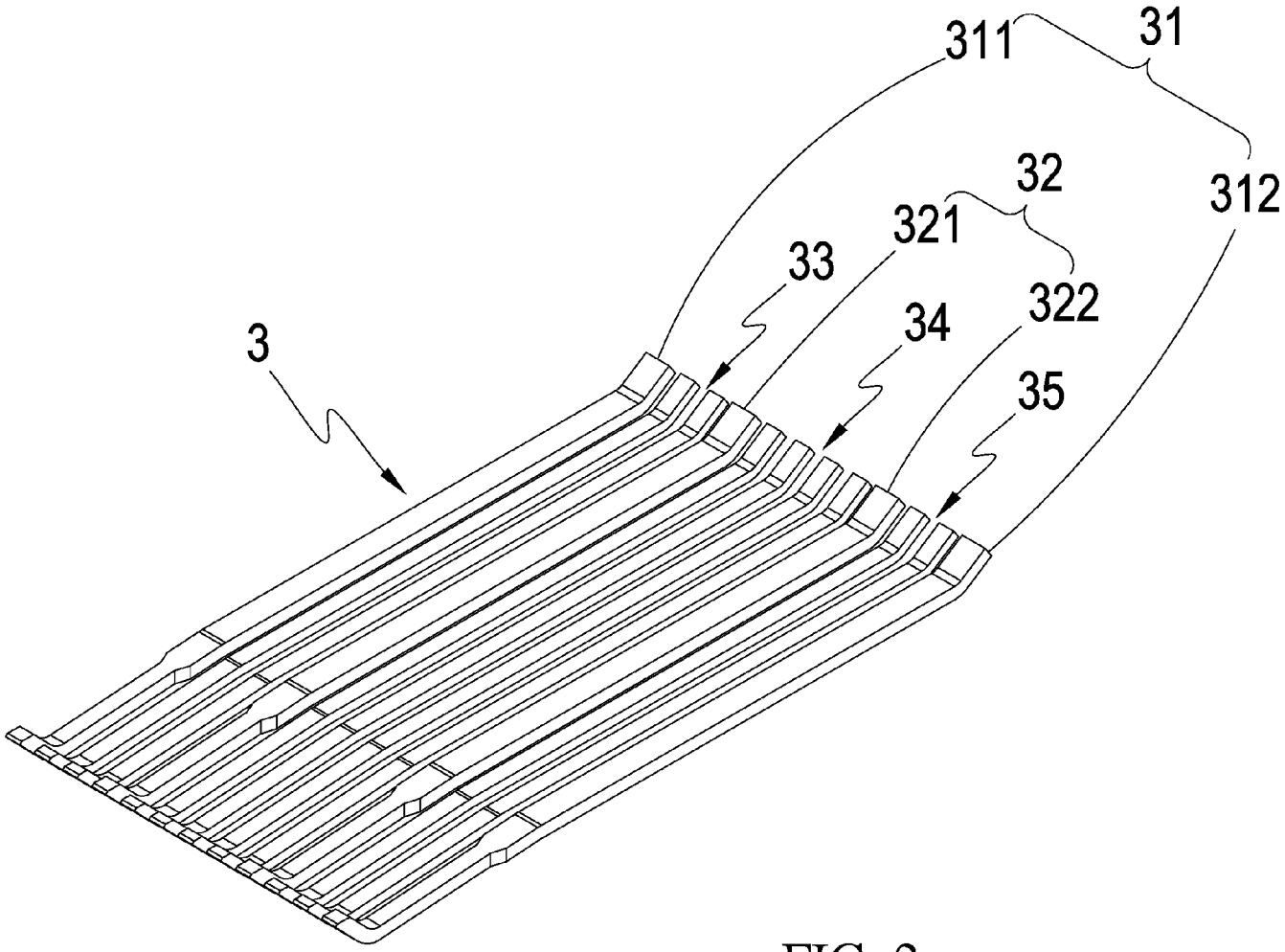
FIG. 2 is a perspective view showing upper transmission conductors of the preferred embodiment of the present invention.
Figure 3:
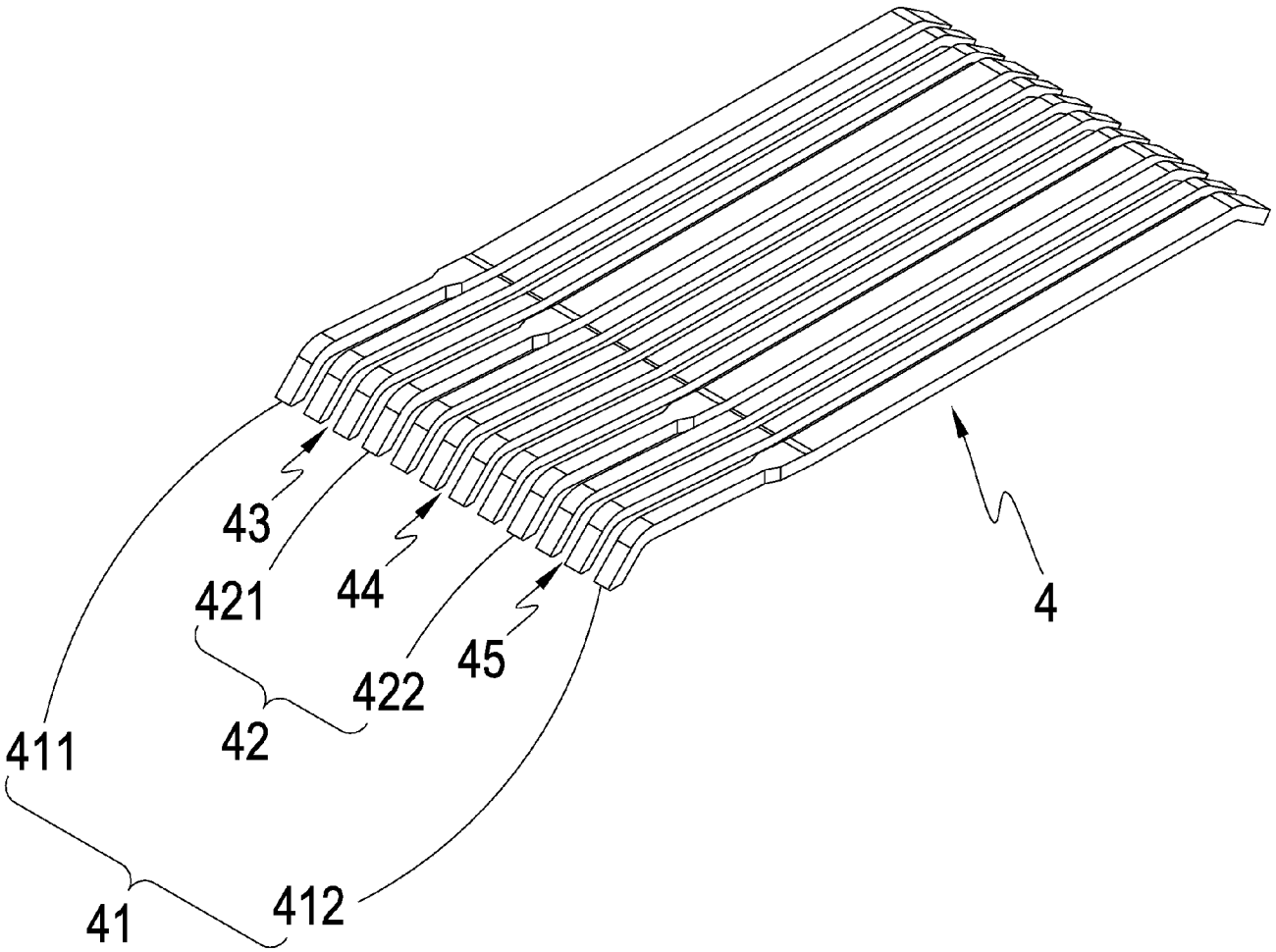
FIG. 3 is a perspective view showing lower transmission conductors of the preferred embodiment of the present invention.
Figure 4:
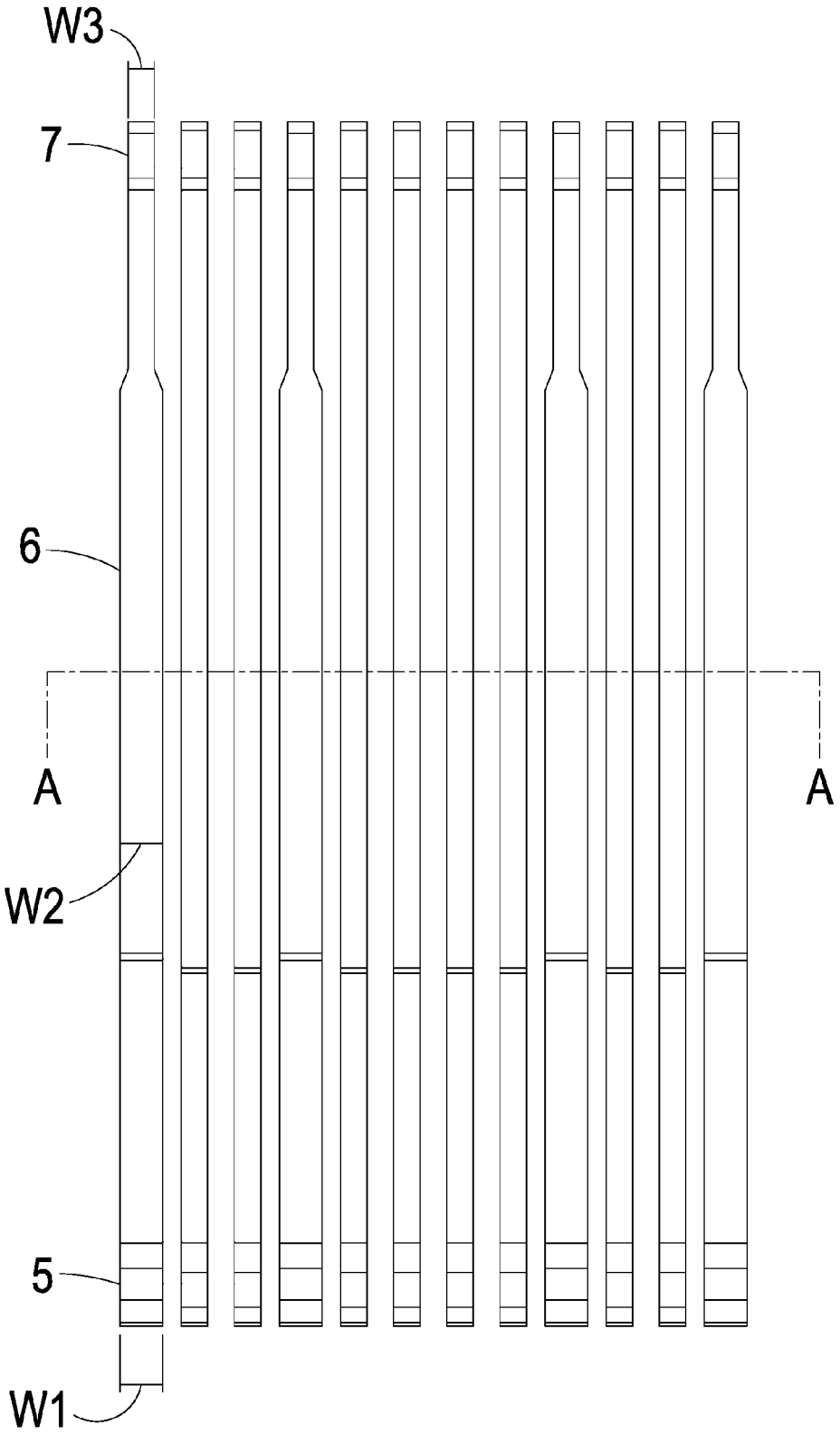
FIG. 4 is a top plan view showing the transmission conductors of the preferred embodiment of the present invention.
Figure 5:
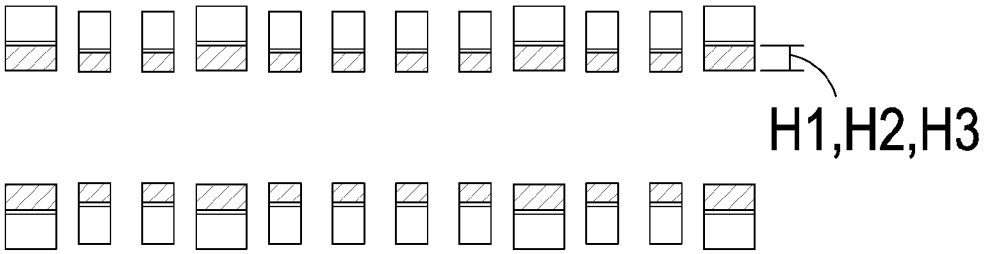
FIG. 5 is a cross-sectional view of the present invention, taken along line A-A of FIG. 4.

As shown in FIGS. 1-5, the drawings clearly show that the present invention comprises:

a shielding enclosure 1;

at least one insulation body 2 arranged inside the shielding enclosure 1;

an upper transmission conductor assembly 3 mounted on the insulation body 2, the upper transmission conductor assembly 3 comprising an upper grounding terminal assembly 31 and an upper power terminal assembly 32 arranged in the upper grounding terminal assembly 31;

a lower transmission conductor assembly 4 mounted to the insulation body 2, the lower transmission conductor assembly 4 comprising a lower grounding terminal assembly 41 and a lower power terminal assembly 42 arranged in the lower grounding terminal assembly 41;

a plurality of soldering sections 5 defined at an end of the upper grounding terminal assembly 31, the upper power terminal assembly 32, the lower grounding terminal assembly 41, and the lower power terminal assembly 42, the soldering sections 5 having a width (first width W1) that is from 0.35 mm to 0.45 mm, the soldering sections 5 having a thickness (first thickness H1) that is from 0.15 mm to 0.25 mm; a plurality of extension sections 6 defined on the upper grounding terminal assembly 31, the upper power terminal assembly 32, the lower grounding terminal assembly 41, and the lower power terminal assembly 42 and located at one side of the soldering sections 5, the extension sections 6 having a width (second width W2) that is from 0.35 mm to 0.45 mm, the extension sections 6 having a thickness (second thickness H2) that is from 0.15 mm to 0.25 mm; and a plurality of contact sections 7 defined on the upper grounding terminal assembly 31, the upper power terminal assembly 32, the lower grounding terminal assembly 41, and the lower power terminal assembly 42 and located at one side of the extension sections 6 that is distant from the soldering sections 5, the contact sections 7 having a width (third width W3) that is from 0.195 mm to 0.295 mm, the contact sections 7 having a thickness (third thickness H3) that is from 0.15 mm to 0.25 mm.

The upper grounding terminal assembly 31 comprises a first upper grounding terminal 311 and a second upper grounding terminal 312 that is arranged at one side of the first upper grounding terminal 311. The upper power terminal assembly 32 comprises a first upper power terminal 321 and a second upper power terminal 322 that is arranged at one side of the first upper power terminal 321. The lower grounding terminal assembly 41 comprises a first lower grounding terminal 411 and a second lower grounding terminal 412 that is arranged at one side of the first lower grounding terminal 411. The lower power terminal assembly 42 comprises a first lower power terminal 421 and a second lower power terminal 422 that is arranged at one side of the first lower power terminal 421.

In addition, the upper transmission conductor assembly 3 further comprises a first upper differential signal terminal assembly 33 that is arranged between the first upper grounding terminal 311 and the first upper power terminal 321, an upper signal terminal assembly 34 that is arranged between the first upper power terminal 321 and the second upper power terminal 322, and a second upper differential signal terminal assembly 35 that is arranged between the second upper power terminal 322 and the second upper grounding terminal 312. The lower transmission conductor assembly 4 further comprises a first lower differential signal terminal assembly 43 that is arranged between the first lower grounding terminal 411 and the first lower power terminal 421, a lower signal terminal assembly 44 that is arranged between the first lower power terminal 421 and the second lower power terminal 422, and a second lower differential signal terminal assembly 45 that is arranged between the second lower power terminal 422 and the second lower grounding terminal 412.

It is appreciated from the above description that the present invention provides a connector that is a male connector, in which a sequence of an arrangement of the upper transmission conductor assembly 3 is the first upper grounding terminal 311, the first upper differential signal terminal assembly 33 (2 pins), the first upper power terminal 321, the upper signal terminal assembly 34 (4 pins), the second upper power terminal 322, the second upper differential signal terminal assembly 35 (2 pins), and the second upper grounding terminal 312; and a sequence of an arrangement of the lower transmission conductor assembly 4 is the first lower grounding terminal 411, the first lower differential signal terminal assembly 43 (2 pins), the first lower power terminal 421, the lower signal terminal assembly 44 (4 pins), the second lower power terminal 422, the second lower differential signal terminal assembly 45 (2 pins), and the second lower grounding terminal 412. Thus, the arrangement of terminals or pins of the present invention comply with the specification of USB Type C 3.1. Under this condition, the soldering sections 5 and the extension sections 6 have an optimum width value that is 0.4 mm and an optimum thickness value that is 0.2 mm. The contact sections 7 have an optimum width value that is 0.245 mm and an optimum thickness value that is 0.2 mm. With such an arrangement, the volume of the terminals can be maximized, in a limited way, so as not to increase noise interference and satisfy a user's need for supply of a large electrical current.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. An electrical connector structure, comprising:

a shielding enclosure;

at least one insulation body arranged inside the shielding enclosure;

an upper transmission conductor assembly mounted on the insulation body, the upper transmission conductor assembly comprising an upper grounding terminal assembly and an upper power terminal assembly arranged in the upper grounding terminal assembly;

a lower transmission conductor assembly mounted to the insulation body, the lower transmission conductor assembly comprising a lower grounding terminal assembly and a lower power terminal assembly arranged in the lower grounding terminal assembly;

a plurality of soldering sections defined at an end of the upper grounding terminal assembly, the upper power terminal assembly, the lower grounding terminal assembly, and the lower power terminal assembly, the soldering sections having a width that is from 0.35 mm to 0.45 mm, the soldering sections having a thickness that is from 0.15 mm to 0.25 mm;

a plurality of extension sections defined on the upper grounding terminal assembly, the upper power terminal assembly, the lower grounding terminal assembly, and the lower power terminal assembly and located at one side of the soldering sections, the extension sections having a width that is from 0.35 mm to 0.45 mm, the extension sections having a thickness that is from 0.15 mm to 0.25 mm; and a plurality of contact sections defined on the upper grounding terminal assembly, the upper power terminal assembly, the lower grounding terminal assembly, and the lower power terminal assembly and located at one side of the extension sections that is distant from the soldering sections, the contact sections having a width that is from 0.195 mm to 0.295 mm, the contact sections having a thickness that is from 0.15 mm to 0.25 mm;

wherein the upper grounding terminal assembly comprises a first upper grounding terminal and a second upper grounding terminal that is arranged at one side of the first upper grounding terminal; the upper power terminal assembly comprises a first upper power terminal and a second upper power terminal that is arranged at one side of the first upper power terminal; the lower grounding terminal assembly comprises a first lower grounding terminal and a second lower grounding terminal that is arranged at one side of the first lower grounding terminal; and the lower power terminal assembly comprises a first lower power terminal and a second lower power terminal that is arranged at one side of the first lower power terminal;

wherein the upper transmission conductor assembly further comprises a first upper differential signal terminal assembly that is arranged between the first upper grounding terminal and the first upper power terminal, an upper signal terminal assembly that is arranged between the first upper power terminal and the second upper power terminal, and a second upper differential signal terminal assembly that is arranged between the second upper power terminal and the second upper grounding terminal;

wherein the lower transmission conductor assembly further comprises a first lower differential signal terminal assembly that is arranged between the first lower grounding terminal and the first lower power terminal, a lower signal terminal assembly that is arranged between the first lower power terminal and the second lower power terminal, and a second lower differential signal terminal assembly that is arranged between the second lower power terminal and the second lower grounding terminal;

wherein the first upper differential signal terminal assembly, the upper signal terminal assembly, and the second upper differential signal terminal assembly of the upper transmission conductor assembly have a width and a thickness that are smaller than the upper grounding terminal assembly and the upper power terminal assembly; and wherein the first lower differential signal terminal assembly, the lower signal terminal assembly, and the second lower differential signal terminal assembly of the lower transmission conductor assembly have a width and a thickness that are smaller than the lower grounding terminal assembly, and the lower power terminal assembly.

2. The electrical connector structure according to claim 1, wherein the soldering sections and the extension sections have an optimum width that is 0.4 mm and an optimum thickness value that is 0.2 mm.

3. The electrical connector structure according to claim 1, wherein the contact sections have an optimum width value that is 0.245 mm and an optimum thickness value that is 0.2 mm.

4. The electrical connector structure according to claim 1, wherein the electrical connector is a male connector.

5. The electrical connector structure according to claim 1, wherein the upper transmission conductor assembly and the lower transmission conductor assembly have terminal arrangements that comply with specification of Universal Serial Bus (USB) Type C.

6. The electrical connector structure according to claim 1, wherein the upper transmission conductor assembly and the lower transmission conductor assembly have terminal arrangements that comply with specification of USB 3.1.

* * * * *